US005931715A

United States Patent [19]

Chang

[11] Patent Number: 5,931,715

[45] Date of Patent: Aug. 3, 1999

[54] SWINGING MECHANISM FOR A TOY TO SIMULATE TAIL MOVEMENT OF AN AQUATIC ANIMAL

[76] Inventor: Chin-Der Chang, 3F, No. 32, Alley 19, Lane 397, Ming-Shui Rd., Chung-Shan Dist., Taipei, Taiwan

[21] Appl. No.: 09/023,378

[22] Filed: Feb. 13, 1998

[30] Foreign Application Priority Data

Dec. 11, 1997 [TW] Taiwan ..... 86220637

[51] Int. Cl.[6] ..... A63H 23/00; A63H 11/00

[52] U.S. Cl. ..... 446/158; 446/156; 446/353

[58] Field of Search ..... 446/154, 156, 446/158, 330, 351, 352, 353, 368

[56] References Cited

U.S. PATENT DOCUMENTS

| | | | |
|---|---|---|---|
| 4,068,401 | 1/1978 | Saitoh | 446/158 |
| 4,636,177 | 1/1987 | Koguchi | 446/353 |
| 4,832,650 | 5/1989 | Tong | 446/156 |
| 5,197,913 | 3/1993 | Suzuki | 446/158 |
| 5,324,225 | 6/1994 | Satoh et al. | 446/353 |
| 5,356,326 | 10/1994 | Ting | 446/353 |

*Primary Examiner*—Robert A. Hafer
*Assistant Examiner*—Laura Fossum
*Attorney, Agent, or Firm*—Webb Ziesenheim Logsdon Orkin & Hanson, P.C.

[57] ABSTRACT

A swinging mechanism for a toy includes a speed-reduction gear assembly driven by a motor, a linkage, a pair of swing blade units, and an eccentric unit. The speed-reduction gear assembly has a drive gear and a driven gear. The linkage has an actuating link and a carrier link. The carrier link has a turning axis between two opposite ends thereof. The actuating link has an end fixed to the carrier link adjacent to the turning axis. Each of the swing blade units has at least an inner blade and an outer blade hinged to one another. The inner blades of the swing blade units have inner ends connected pivotally and respectively to the two opposite ends of the carrier link. The outer blades of the swing blade units are juxtaposed side by side and have outer ends connected pivotally to one another. The inner and outer blades of the swing blade units have adjoining ends between the inner and outer ends, and hinge pins which interconnect the adjoining ends, respectively. The hinge pins are parallel to the turning axis of the carrier link. The eccentric unit interconnects the driven gear and the actuating link for turning the carrier link by rocking the actuating link so as to pull one of the inner blades inward while pushing the other one of the inner blades outward, thereby simultaneously turning the outer blades to and fro about the hinge pins.

3 Claims, 4 Drawing Sheets

SWINGING MECHANISM FOR A TOY TO SIMULATE TAIL MOVEMENT OF AN AQUATIC ANIMAL

BACKGROUND OF THE INVENTION

1. Field of the Invention

This invention relates to a swinging mechanism, more particularly to a swinging mechanism for a toy.

2. Description of the Related Art

Referring to FIG. 1, a conventional swinging mechanism for a toy for simulating the tail movement of an aquatic animal is shown to comprise a speed-reduction gear assembly 11 and a rotating shaft 12. The rotating shaft 12 has one end connected to the speed-reduction gear assembly 11 in order to rotate therewith. The other end of the rotating shaft 12 has an eccentric shaft 13 connected thereto. The distal end of the eccentric shaft 13 is connected pivotally to a slide groove 14 of a swing blade 15. When driven by the speed-reduction gear assembly 11, the eccentric shaft 13 pushes the internal face which defines the slide groove 14, thereby resulting in swinging of the swing blade 15. However, the swinging of the swing blade 15 does not result in a realistic simulation of the tail movement of an aquatic animal.

SUMMARY OF THE INVENTION

An object of the present invention is to provide a swinging mechanism for toy which can be used to simulate more realistically the tail movement of an aquatic animal as compared to the conventional swinging mechanism.

According to the present invention, a swinging mechanism for a toy comprises:

a motor having an output shaft;

a speed-reduction gear assembly having a drive gear and a driven gear meshed with the drive gear, the drive gear being mounted to the output shaft of the motor so as to drive the driven gear;

a linkage having an actuating link and a carrier link with two opposite ends, the carrier link having a turning axis between the two opposite ends, the actuating link having a first end fixed to the carrier link adjacent to the turning axis;

a pair of swing blade units, each having at least an inner blade and an outer blade hinged to one another, the inner blades of the swing blade units having inner ends connected pivotally and respectively to the two opposite ends of the carrier link, the outer blades of the swing blade units being juxtaposed side by side and having outer ends connected pivotally to one another, the inner and outer blades of the swing blade units having adjoining ends between the inner and outer ends and hinge pins which interconnect the adjoining ends respectively, the hinge pins being parallel to the turning axis of the carrier link; and eccentric means connected to the driven gear and the actuating link for turning the carrier link by rocking the actuating link so as to pull one of the inner blades inward while pushing the other one of the inner blades outward, thereby simultaneously turning the outer blades to and fro about the hinge pins.

BRIEF DESCRIPTION OF THE DRAWINGS

Other features and advantages of the present invention will become apparent in the following detailed description of a preferred embodiment of the invention, with reference to the accompanying drawings, in which.

DETAILED DESCRIPTION OF THE PREFERRED EMBODIMENT

Figure 1:
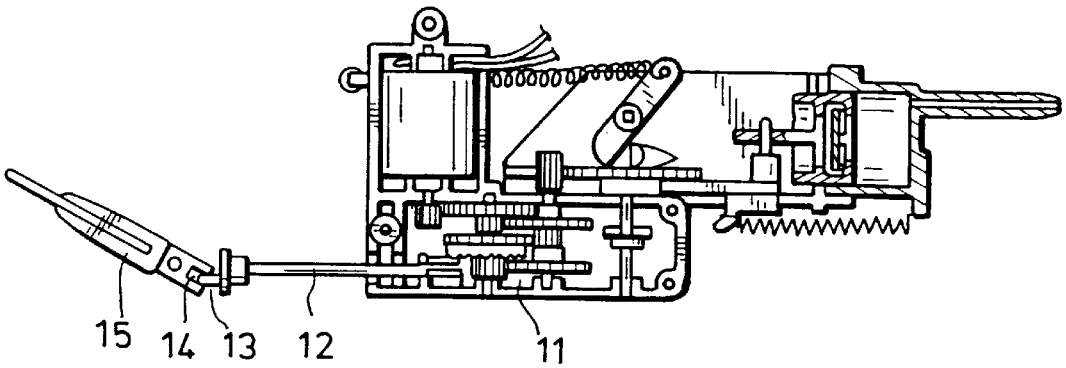
FIG. 1 PRIOR ART
FIG. 1 is a sectional side view of a toy having a conventional swinging mechanism for simulating tail movement of an aquatic animal.
Figure 2:
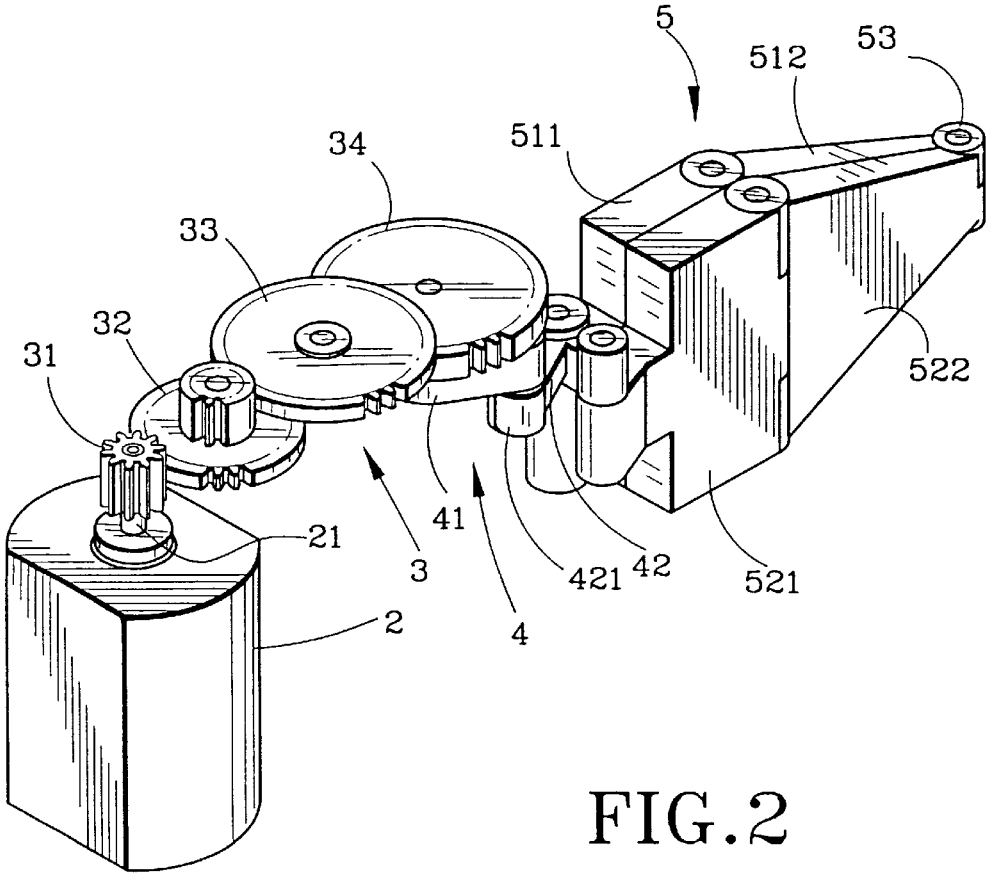
FIG. 2 is a perspective view of a preferred embodiment of a swinging mechanism for a toy according to the present invention.
Figure 3:
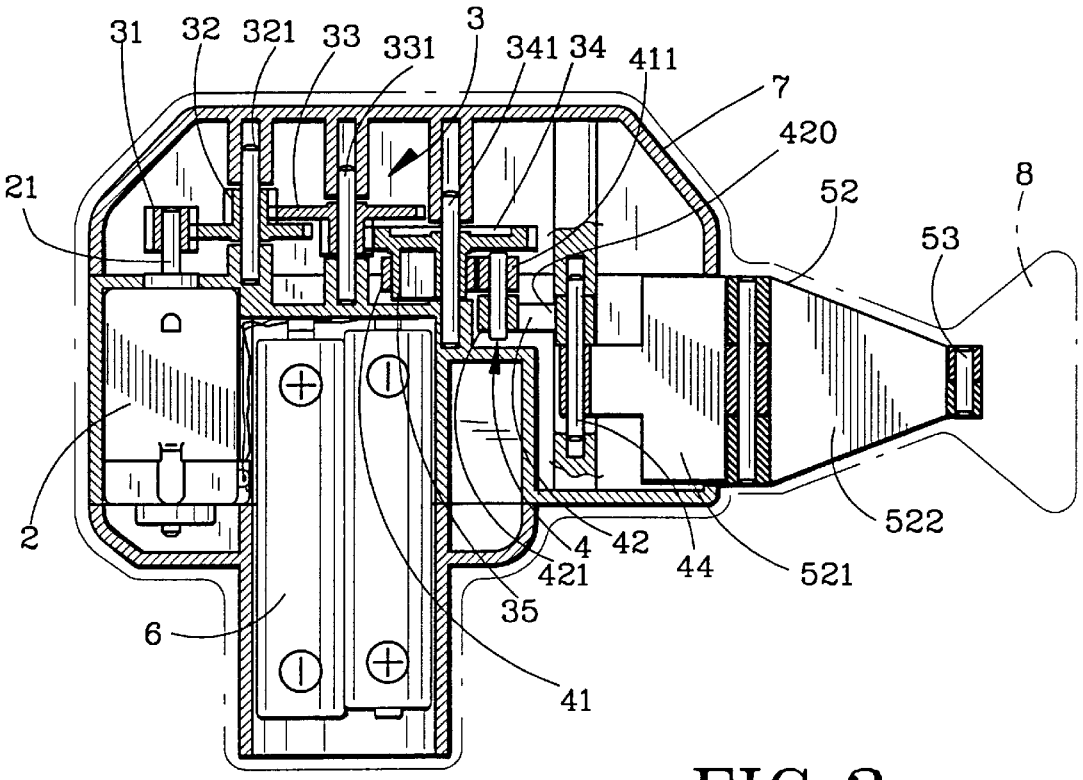
FIG. 3 is a sectional view of the preferred embodiment of the swinging mechanism for a toy according to the present invention.
Figure 4:
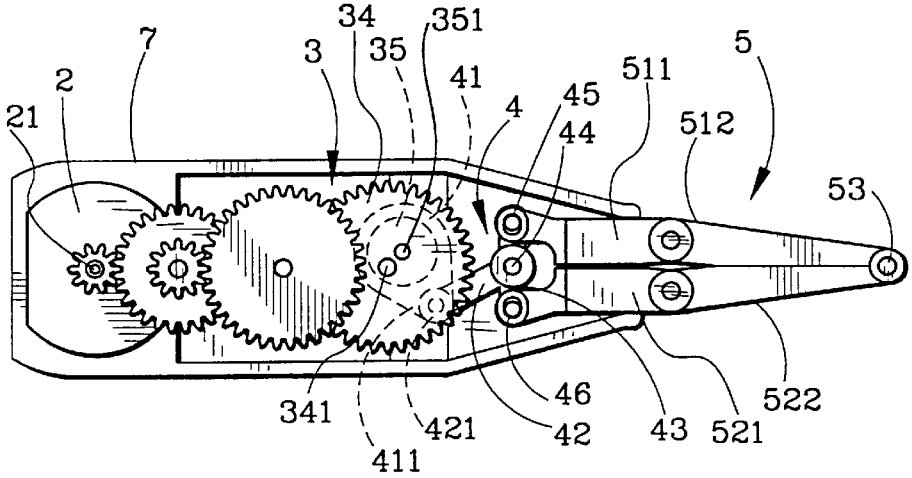
FIG. 4 is a top view of the swinging mechanism for a toy according to the present invention.

Referring to FIGS. 2, 3 and 4, a preferred embodiment of a swinging mechanism for a toy according to the present invention is shown to comprise a motor 2, a speed-reduction gear assembly 3, a linkage 4 and a pair of swing blade units 5.

The motor 2 is mounted in a housing 7 and is connected electrically to a power source 6 which is received in the housing 7.

The speed-reduction gear assembly 3 includes a drive gear 31, two transmission gears 32, 33 and a driven gear 34 which mesh with to one another. The drive gear 31 is mounted to the output shaft 21 of the motor 2 for co-rotation therewith. The transmission gears 32, 33 and the driven gear 34 rotate respectively about axles 321, 331, 341 which are mounted in the housing 7.

Figure 5:
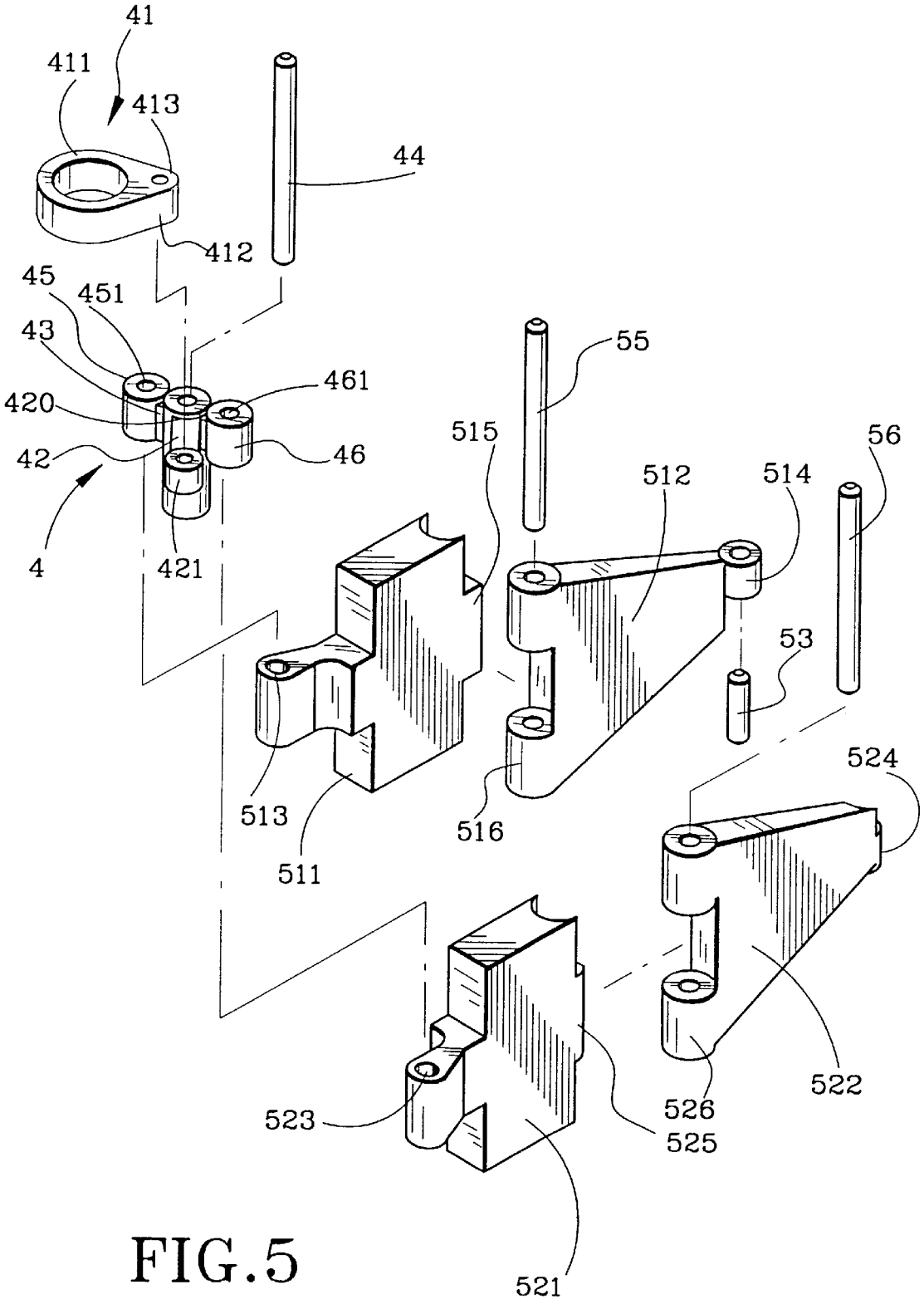
FIG. 5 is an exploded view of the preferred embodiment of the swinging mechanism for a toy according to the present invention.

Referring to FIG. 5, the linkage 4 has an actuating link 42 and a carrier link 43 with two opposite ends 45, 46. A turning shaft 44, which is mounted in the housing 7, passes through the central portion of the carrier link 43 between the two opposite ends 45, 46 to form a turning axis for the carrier link 43. The turning shaft 44 is parallel to the axles 321, 331, 341 of the speed-reduction gear assembly 3. Each of the opposite ends 45, 46 is formed as a cylindrical pivot seat with an axial hole 451, 461. The actuating link 42 has a first end 420 fixed to the central portion of the carrier link 43 adjacent to the turning shaft 44.

Referring to FIGS. 2, 3, 4 and 5, each of the swing blade units 5 has an inner blade 511, 521 and an outer blade 512, 522 hinged to one another. The inner blades 511, 521 of the swing blade units 5 have inner ends 513, 523 connected pivotally and respectively to the two opposite ends 45, 46 of the carrier link 43. The outer blades 512, 522 of the swing blade units 5 are juxtaposed side by side and have outer ends 514, 524 connected pivotally to one another by a common pin 53. The inner and outer blades 511, 512, 521, 522 of the swing blade units 5 have adjoining ends 515, 516, 525, 526 between the inner and outer ends 513, 514, 523, 524, and hinge pins 55, 56 which interconnect the adjoining ends 515, 516, 525, 526, respectively. The hinge pins 55, 56 are parallel to the turning shaft 44 of the carrier link 43.

Figure 6:
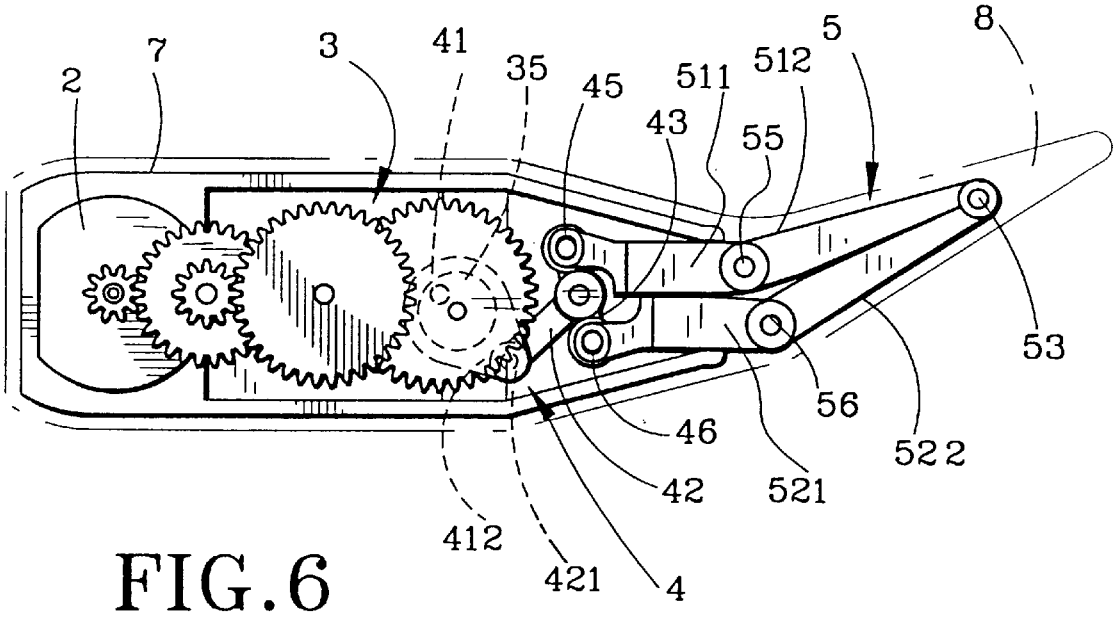
FIG. 6 is a top schematic view illustrating the swing blade units of the swinging mechanism for a toy according to the present invention in a first operative position.
Figure 7:
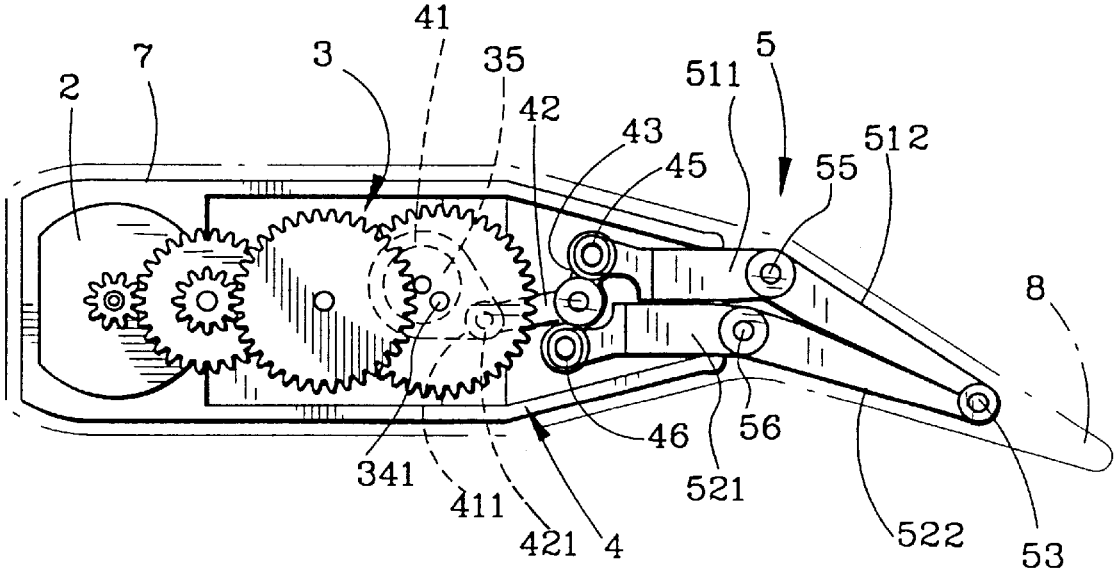
FIG. 7 is a top schematic view illustrating the swing blade units of the swinging mechanism for a toy according to the present invention in a second operative position.

The driven gear 34 is provided with eccentric means which is connected to the actuating link 42. The eccentric means includes an eccentric mounting member 35 of circular cross-section provided eccentrically on the driven gear 34. The eccentric mounting member 35 has an axis 351 parallel to the turning shaft 44 of the carrier link 43. The eccentric means further includes a cam member 41 with a hollow circular portion 411 which is sleeved rotatably on the eccentric mounting member 35, and a lobe portion 412 extending radially from the circular portion 411. The lobe portion 412 has a distal end 413 connected pivotally to a second end 421 of the actuating link 42 which is opposite to the first end 420 about a pivot axis parallel to the turning shaft 44 of the carrier link Referring to FIGS. 4, 6 and 7, when the speed-reduction gear assembly 3 is driven by the motor 2, the cam member 41 rotates with the eccentric mounting member 35, thereby resulting in rocking of the actuating link 42. The carrier link 43 is then turned about the turning shaft 44 so as to pull one of the inner blades 511 (521) inward while pushing the other one of the inner blades 521 (511) outward, thereby simultaneously turning the outer blades 512, 522 to and fro about the hinge pins 55, 56, as best illustrated in FIGS. 6 and 7. In this way, swinging of the swing blade units 5 is more flexible than that of the swing blade of the aforementioned conventional swinging mechanism. Therefore, the swing blade units 5 can more realistically simulate the tail movement of an aquatic animal as compared to the swing blade of the conventional swinging mechanism described beforehand.

Furthermore, the actuating link 42 and the carrier link 43 form an angle therebetween in such a manner that the pivot axis of the distal end 413 of the lobe portion 412 and the second end 421 of the actuating link 42 is constantly out of alignment with a line interconnecting the turning shaft 44 and the axis 351 of the eccentric mounting member 35 when the cam member 41 rotates about the eccentric mounting member 35. As such, no dead point between the cam member 41 and the actuating link 42 will occur when the cam member 41 rotates, thereby resulting in smooth swinging movement of the swing blade units 5.

In addition, a sheath 8 encloses the housing 7. The sheath 8 is shaped as an aquatic animal and is made of a soft, waterproof, fire retardant material. The portion of the sheath 8 corresponding to the tail of the aquatic animal covers the swing blade units 5. Thus, the swing blade units 5 can simulate realistically the tail movement of the aquatic animal when the swinging mechanism is actuated.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A swinging mechanism for a toy to simulate a tail movement of an aquatic animal, comprising:

a motor having an output shaft;

a speed-reduction gear assembly having a drive gear and a driven gear meshed with said drive gear, said drive gear being mounted to said output shaft of said motor so as to drive said driven gear;

a linkage having an actuating link and a carrier link with two opposite ends, said carrier link having a turning axis between said two opposite ends, said actuating link having a first end fixed to said carrier link adjacent to said turning axis;

a pair of swing blade units, each having at least an inner blade and an outer blade hinged to one another, said inner blades of said swing blade units having inner ends connected pivotally and respectively to said two opposite ends of said carrier link, said outer blades of said swing blade units being juxtaposed side by side and having outer ends connected pivotally to one another, said inner and outer blades of said swing blade units having adjoining ends between said inner and outer ends, and hinge pins which interconnect said adjoining ends respectively, said hinge pins being parallel to said turning axis of said carrier link; and eccentric means connected to said driven gear and said actuating link for turning said carrier link by rocking said actuating link so as to pull one of said inner blades inward while pushing the other one of said inner blades outward, thereby simultaneously turning said outer blades to and fro about said hinge pins.

2. The swinging mechanism for a toy as claimed in claim 1, wherein said driven gear has an axle parallel to said turning axis, said eccentric means including an eccentric mounting member of circular cross-section provided eccentrically on said driven gear, said eccentric mounting member having an axis parallel to said turning axis of said carrier link, said eccentric means further including a cam member with a hollow circular portion sleeved rotatably on said eccentric mounting member, and a lobe portion extending radially from said circular portion, said lobe portion having a distal end connected pivotally to a second end of said actuating link which is opposite to said first end of said actuating link about a pivot axis parallel to said turning axis of said carrier link.

3. The swinging mechanism for a toy as claimed in claim 2, wherein said actuating link and said carrier link form an angle therebetween in such a manner that said pivot axis of said distal end of said lobe portion and said second end of said actuating link is constantly out of alignment with a line interconnecting said turning axis and said axis of said eccentric mounting member when said cam member rotates about said eccentric mounting member.

* * * * *